US005455991A

United States Patent [19]

Long et al.

[11] Patent Number: 5,455,991

[45] Date of Patent: Oct. 10, 1995

[54] METHOD AND APPARATUS FOR COLLECTING FIBERS, AND PRODUCT

[75] Inventors: James M. Long, Toledo; Daniel L. Kepling, Grand Rapids; Timothy M. Nijakowski, Swanton, all of Ohio

[73] Assignee: Schuller International, Inc., Denver, Colo.

[21] Appl. No.: 191,406

[22] Filed: Feb. 3, 1994

[51] Int. Cl.[6] ..... D01G 23/08; B65G 53/40

[52] U.S. Cl. ..... 19/308; 65/476; 65/505; 264/121; 19/304

[58] Field of Search ..... 19/304, 308, 296; 28/105; 162/217; 186/62.2, 285; 425/831; 264/121

[56] References Cited

U.S. PATENT DOCUMENTS

| | | | |
|---|---|---|---|
| 3,575,472 | 4/1970 | Brewster et al. | 19/308 X |
| 3,787,930 | 8/1971 | Allen | 19/308 X |
| 3,903,570 | 10/1972 | Rowe, III | 19/308 X |
| 4,153,977 | 5/1979 | Moser | 19/308 X |
| 4,167,404 | 9/1979 | Loeffler et al. | 65/4 |
| 4,495,119 | 1/1985 | Chung | 264/121 X |
| 4,744,810 | 5/1988 | Battibelli et al. | 264/121 X |
| 4,936,934 | 6/1990 | Buehning | 19/308 X |
| 5,056,195 | 10/1991 | Furtak et al. | 19/304 |
| 5,111,552 | 5/1992 | Lauren et al. | 19/308 |

FOREIGN PATENT DOCUMENTS

| | | | |
|---|---|---|---|
| 1567663 | 5/1990 | U.S.S.R. | 19/308 |
| 1590490 | 9/1990 | U.S.S.R. | 19/308 |

*Primary Examiner*—John J. Calvert
*Attorney, Agent, or Firm*—Cornelius P. Quinn

[57] ABSTRACT

Disclosed are an improved apparatus for collecting fine fibers, such as glass fibers, having a mean diameter of less than two microns from a gaseous stream, a method of collecting fine fibers using the apparatus and the novel new product produced by this method. The improvement lies mainly in the way in which the collection drum is supported and sealed which allows the collection to take place at relatively high partial vacuums. The fiber is also consolidated in the gaseous stream by passing it through a duct having at least one approximately ninety degree turn therein.

12 Claims, 5 Drawing Sheets

METHOD AND APPARATUS FOR COLLECTING FIBERS, AND PRODUCT

BACKGROUND

1. Field of the Invention

The present invention involves a fiber collection system and more particularly a collection system for collecting very small diameter staple fibers such as fibers having an average diameter of less than 1.5–2 microns. The collection system disclosed, and the method of using it, is particularly effective for collecting fibers having a mean diameter of less than one micron such as glass microfibers used to make high efficiency particle arresting filters for cleanrooms. The fiber product collected is believed to contain a higher percentage of smaller diameter fibers than have been present in fiber products heretofore.

2. Discussion of the Prior Art

A known system and method for collecting small diameter fibers is disclosed in United States Patent 4,167,404, the disclosure of which is hereby incorporated by reference. The system disclosed in this reference (Loeffler system) has been representative of the state of art in this technology for many years until the present invention. In the system described in this patent, minute fibers having diameters from a few hundredths of a micron to many microns, but averaging about 0.1 to about 2 microns, suspended in a rapidly moving hot gaseous stream containing products of combustion and air are largely removed from the gaseous stream on a woven wire screen on the surface of a rotating permeable drum.

While the Loeffler system has functioned well for many years it still has some limitations and short comings. It was designed to operate with pressure drops of less than one inch of water and actually was operated most efficiently at pressure drops of about one-half an inch of water pressure. One of the reasons for this limitation is that the interior seals on the collection drum won't hold up and leak as the drum tends to go out of round due to the constant heating and cooling. Also the exterior seal that rides across the screen on the collection drum leaks due to the uneven nature of a woven screen surface reducing further the pressure drop across the collection surface of the drum.

Another undesirable feature of the Loeffler system is that the fiber is very hot as it is removed from the collection drum, as high as 300 degrees Fahrenheit. This is too hot to handle or to package in plastic bags and has to be handled with insulating gloves or mechanically until it has cooled. Cooling takes considerable time since the compressed fiber has excellent thermal insulating properties.

Other undesirable features of the Loeffler system are the maintenance required to occasionally replace the screen used on the collection surface of the drum and the need to water cool the drum axle bearing that sets in the hot exhaust air to achieve decent bearing life. Also, the method of removing the fibers from the collection drum by winding on a mandrel makes closing up the system very difficult and expensive, and it is desirable to close up the system to prevent external contamination and improve the working environment. Finally, the ever increasing cost of energy and standards for exhaust air cleanliness from manufacturing processes create a need for a system having still higher collection efficiency and lower volumes of exhaust air per unit of product produced.

BRIEF DESCRIPTION OF THE INVENTION

The present invention includes an apparatus for collecting fibers from a gaseous stream comprising a rotatable drum having a permeable circumferential surface, means for supporting the drum, means for rotating the drum, means for creating a partial vacuum of at least minus one and one-half (1.5) inch water column inside a portion of the drum with seal means cooperating with the surface of the drum to constrain the partial vacuum to a selected portion of the interior of the permeable drum, an enclosure surrounding a major portion of the circumferential surface of the drum for directing the gaseous stream and fibers to the circumferential surface of the drum, and means for removing collected fibers from the drum, wherein the circumferential surface of the drum is a self supporting perforated metal sheet having holes therethrough with a diameter up to about 0.1 inch, the cross sectional area of the holes making up at least 20 percent and preferably at least 35 percent of the area of the circumferential surface, the means supporting the drum engaging the inner circumferential surface of a support ring attached to each end of the metal sheet at or close to the ends of the drum in a low friction manner so that the drum can rotate freely, and seal means biased against the rotating drum capable of cooperating with the means for creating a partial vacuum to achieve at least minus two inches of water column on the interior of a portion of said drum while the remainder of the interior of said drum is at essentially ambient pressure. An additional optional feature of the invention is a water cooled S shaped section in the duct leading to the drum constraining the flow of gases and fiber. This section cools the stream some densifying the volume of gases and the S shaped motion consolidates the fibers making collection more efficient. Water cooling also permits the use of low cost carbon steel sheet metal for the S section even though the internal temperature at the initial impact area is so high as to otherwise require a ceramic or refractory metal or alloy.

The process of collecting fibers using this apparatus and the fiber product collected using this drum is also part of the present invention.

DETAILED DESCRIPTION OF THE INVENTION

Figure 1:
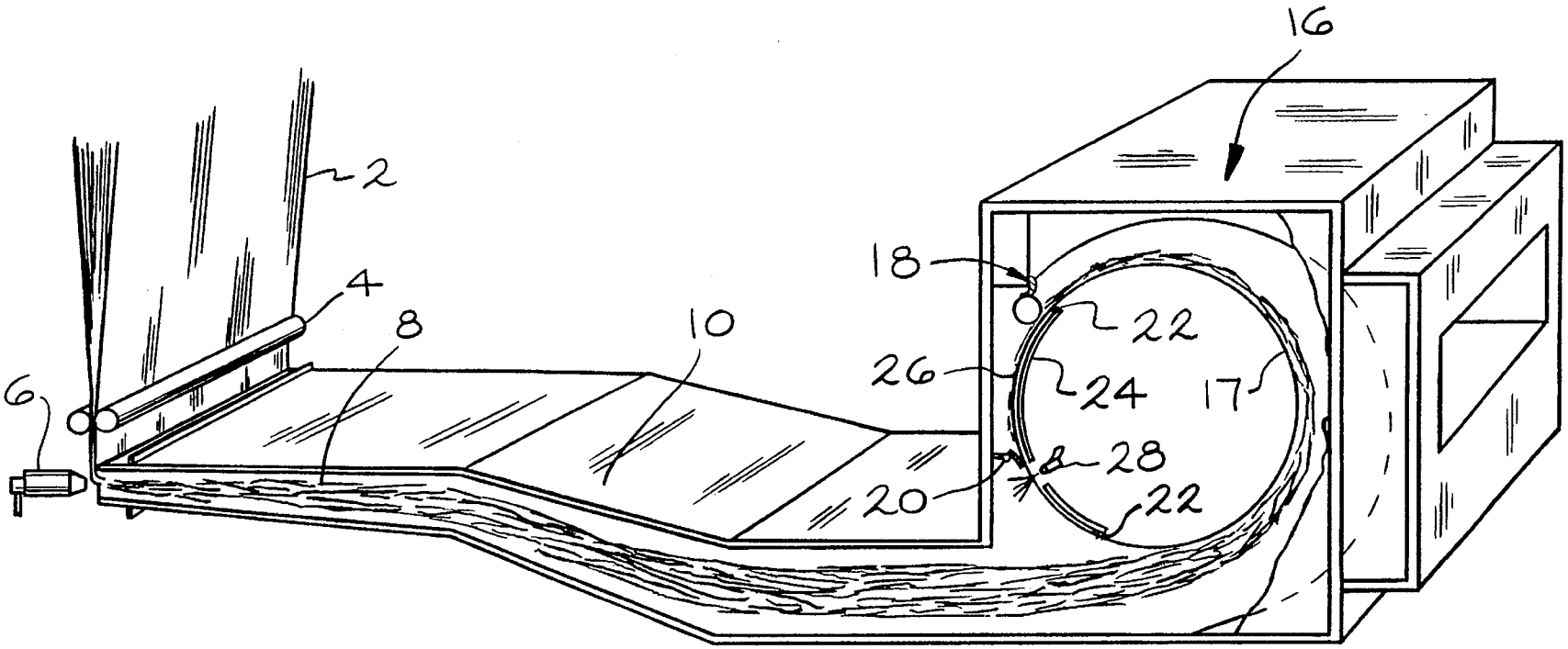
FIG. 1 PRIOR ART
FIG. 1 is a schematic of the apparatus and process disclosed in U.S. Pat. No. 4,167,404.

FIG. 1 shows a prior art Loeffler system for making and collecting fine glass fibers. In this process glass primaries or small diameter glass rods 2 are pulled and guided by rolls 4 into the path of a high velocity and high temperature gaseous blast created by burner 6, such as the burner disclosed in U.S. Pat. No. 3,736,094. The hot gaseous blast from the burner 6 melts the rods and attenuates the molten glass into fine fibers 8 having average diameters generally less than 2 microns, preferably less than 1 micron and most preferably less than 0.8 micron. The lengths of the fibers vary and are not measurable to date because the aspect ratio is so high. The diameters are so small that the individual fibers can only be seen with the aid of microscopy and only one end of a fiber can be seen in the field of view.

The fine fibers 8 entrained in the gaseous stream of combustion gases and inspirated air is constrained in a duct or forming tube 10 as it is drawn into enclosure 16 housing an axially mounted rotating collection drum 17. The circumferential surface of the drum 17 is permeable and covered with a screen and a partial vacuum of less than 1 inch is maintained in the drum which pulls the gasses through the drum surface leaving most of the fibers on the screen.

Figure 3:
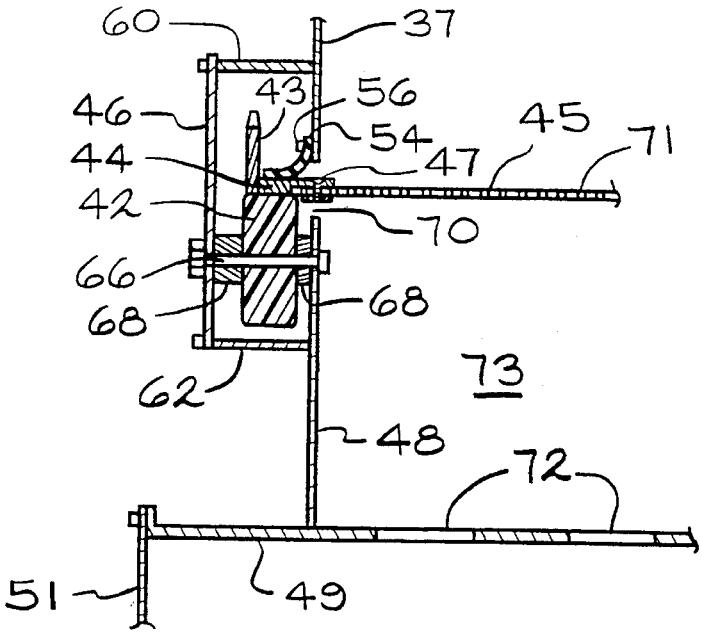
FIG. 3 is a cross section viewing along lines 3—3 in FIG. 2 showing how the supporting rollers 42 are attached.
Figure 4:
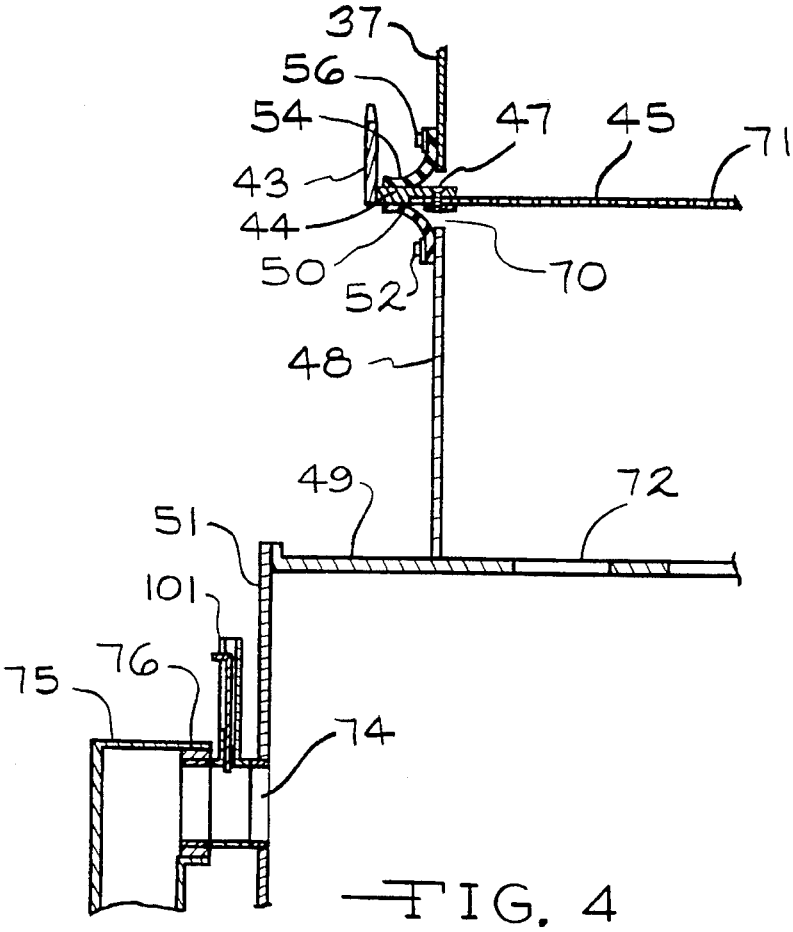
FIG. 4 is a cross section viewing along lines 4—4 in FIG. 2 showing the drum assembly and drum seals.
Figure 5:
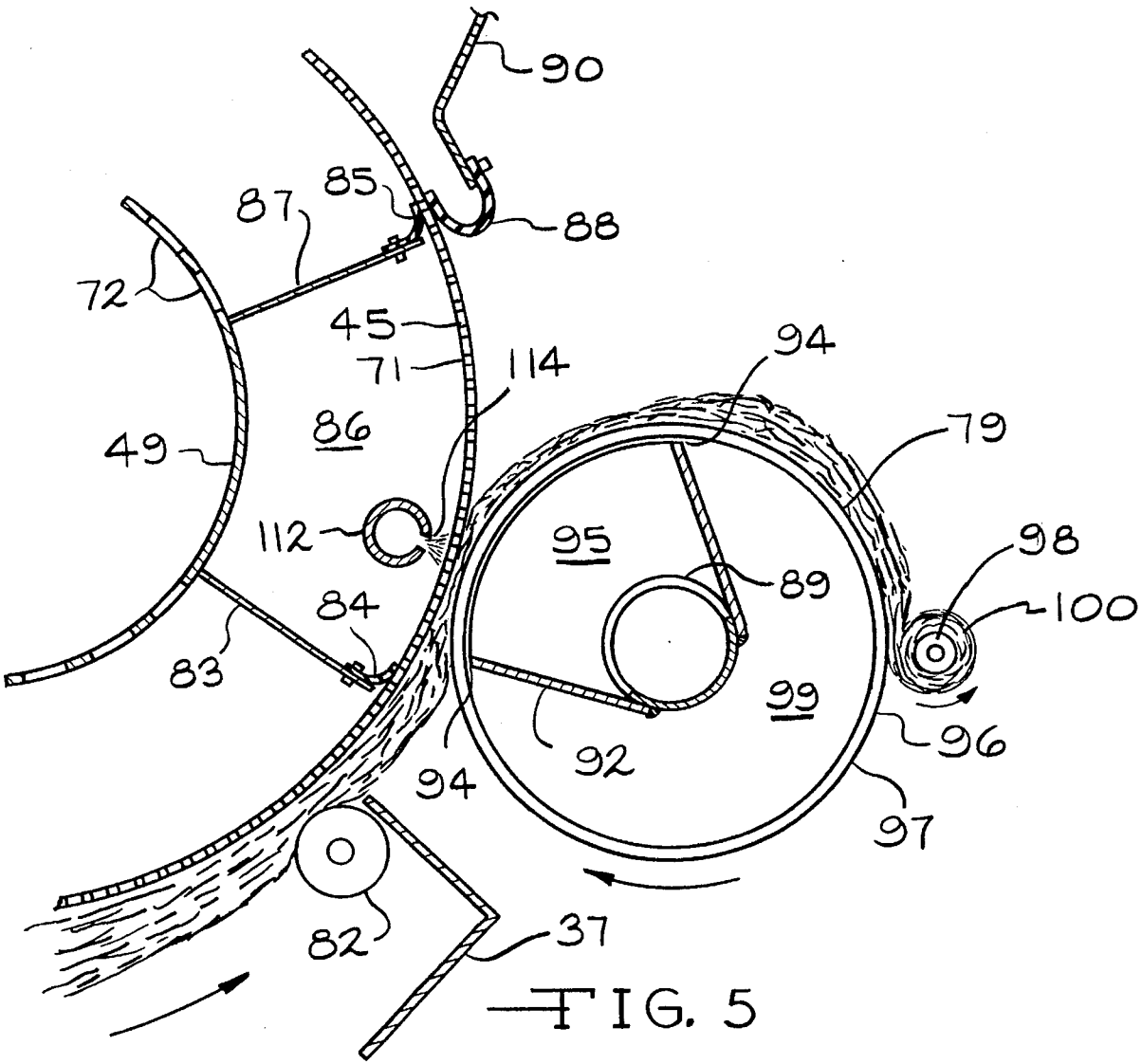
FIG. 5 is a partial cross section of the drum, the take off roll and the take up mandrel and shows how certain portions of the interiors of the drum and take off roll are isolated from the remainder of the interiors.

Seals 18, 20 and 22 along with other circumferential seals (items 46 of FIG. 5, 44 of FIG. 3 and 45 of FIG. 4 of U.S. Pat. No. 4,167,404) that run against the inner surface of the drum contain the partial vacuum to about 270 degrees of the drum. The other portion of the drum surface adjacent plate 24 is at ambient pressure so that the collected fiber can be removed from the drum at point 26 by a mechanism not shown. An air knife 28 fixedly mounted on the interior of the drum 17 blows air at high velocity through the drum and collecting screen from inside to outside of the drum to clean that portion of the collecting screen after the collected fibers have been removed.

The limitations with this system are that the drum, being very large, gets out of round and wears the seals so fast that is impractical to achieve a partial vacuum much above one-half inch WC and to pull enough gases through the drum it is necessary to rotate the drum fast enough to accumulate only a thin layer of fibers on the drum surface. The fibers collecting on the surface form a very fine filter having a higher and higher pressure drop across the layer as the layer increases in thickness. As soon as the pressure drop across the layer of fiber approaches the partial vacuum on the interior of the drum the amount of gases being drawn through the drum is insufficient to prevent pressure buildup in the forming tube 10 and the drum must be rotated faster and/or the throughput must be reduced to prevent the gases and fiber from blowing back around the burner 6. When running with a thin layer a significant amount of very fine fibers having the shortest lengths are pulled through the holes in the screen and are lost as waste in the abatement system for the waste gases.

In the present invention, shown in FIGS. 2–6, a way has been found to overcome the seal problem of the apparatus described above and it has been discovered that running at a much higher pressure drop of at least 2 inches WC and preferably 5–8 inches, by running a much thicker fiber layer on the drum, improves both the collection efficiency and the throughput.

Figure 2:
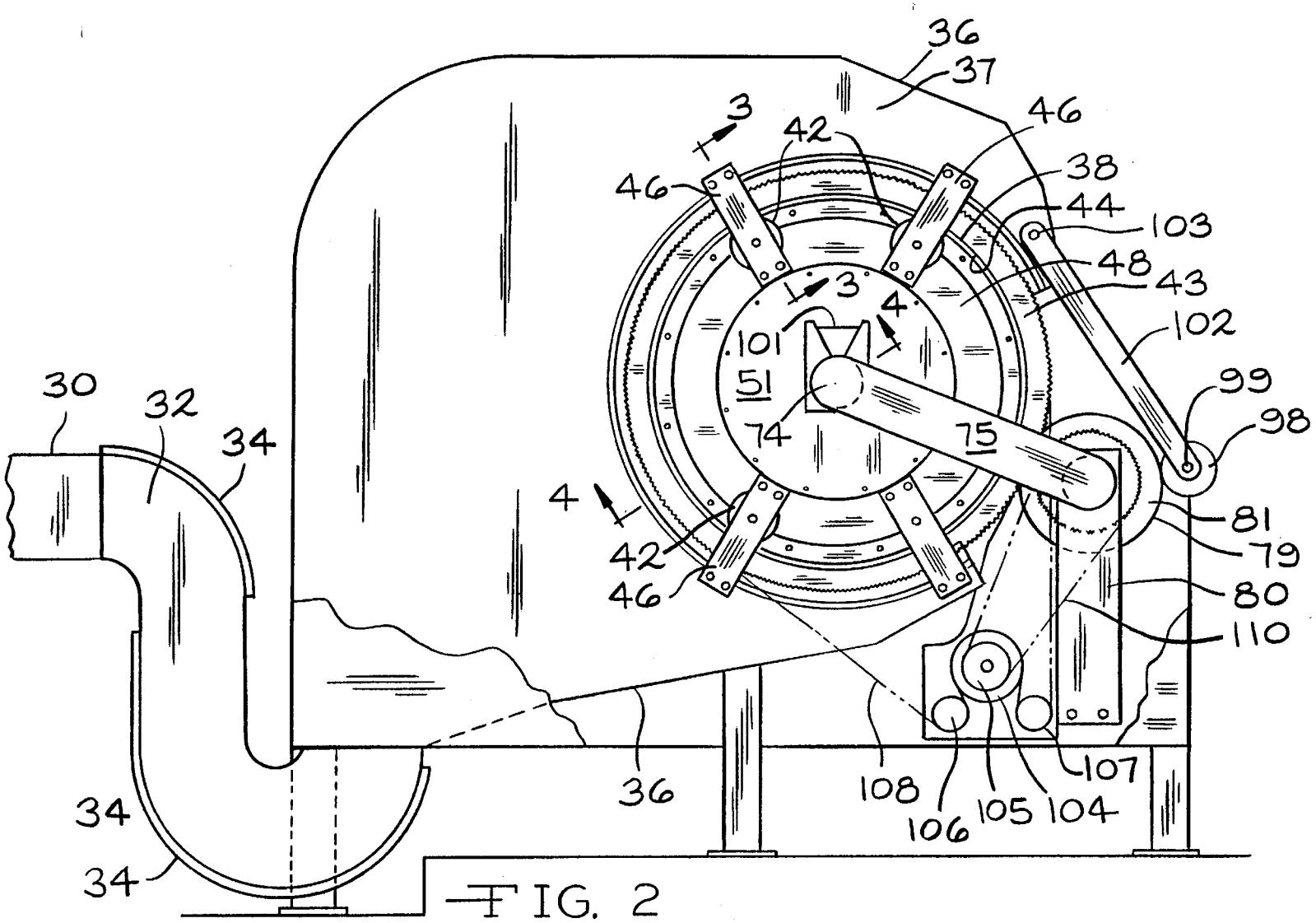
FIG. 2 is a side view of the apparatus of the present invention.

FIG. 2 shows the collection system of the present invention absent the fiber forming portion which is unchanged from that described above. The gaseous stream containing the fibers passes through the forming tube 30 and through a section 32 having one to three ninety degree turns therein and entering a chamber 36 such that the fiber stream direction as it enters the chamber 36 is parallel or tangential to the collecting surface. The section 32 has water cooled panels 34 on the surfaces of the outside curves. The water cooling cools the gaseous stream several degrees, increasing its density and aiding its removal from the fiber later in the process. The section 32 also consolidates the fiber in the stream causing it to form clouds of fiber that enhances fiber collection.

From the section 32 the gaseous stream with the fiber consolidated therein passes into chamber 36 having sidewalls 37, all of which partly surround the circumferential surface of a collection drum 38. The drum 38 is supported in rotatable fashion by a plurality of rollers 42 which run against the inner circumferential surfaces of sprocket 43, and a support ring 44 (see FIG. 3) at each end of the drum. If the sheet making up the collection drum is sufficiently thick the support rings 43 would not be necessary, but the drum would be undesirably heavy. The rollers 42 are supported by plates 46 that are fastened at one end to a bracket attached to the sidewalls 37 of chamber 36 and at the other end to a bracket attached to an inner ring support 48 (see FIG. 3).

Referring to FIG. 3, which is a cross section through one of the rollers 42 along lines 3—3 of FIG. 2, the roller and drum assemblies are shown in more detail. The drum is made up of a perforated carbon or stainless steel sheet rolled to the desired diameter and but welded—the weld is ground smooth with the remainder of the drum on both the interior and the exterior. A wide range of sizes of perforated sheet are suitable. The thickness should be sufficient that the drum retains its shape and that it doesn't sag across its length. A suitable material is 16 gauge carbon steel with 0.079 inch diameter holes on one-eighth inch staggered centers having 36% open area and hard chrome plated on its surface. Thicker perforated sheet can be used, but it adds weight and makes the perforating of the sheet more costly. A drum capable of collecting the product of three attenuating burners is forty four inches in diameter by forty six inches long. Other hole sizes and patterns and drum sizes will be suitable as long as the functional requirements of the apparatus described here are met.

The perforated drum is retained on each end in a close fitting slot in the side of support ring 44 by recessed bolts 47. The tops of bolts 47 should be flush with the top of support ring 44. A sprocket 43 is attached to the support ring 44 on each end of the drum such that the inner circumferential surface of each sprocket 43 aligns with the inner circumferential surface of each ring 44 to form wide smooth surfaces for rollers 42 to run on.

The roller 42 is supported by its axle 66 which is supported on one end by inner ring 48 and on the other end by a plate 46. Plate 46 is mounted at one end to the chamber sidewall 37 with a bracket 60 and at the other end to inner ring 48 with a bracket 62. Spacers 68 on both sides of the roller 42 keep the roller in the proper location.

FIG. 3 also shows one of the seals that is a key feature of the present invention. A flexible seal 54 is mounted to the sidewall 37 with a bolted retainer ring 56 in such a way that the seal is biased against the upper surface of support ring 44 in a sealing relationship. The seal extends all the way around each end of the drum and prevents the flow of outside air into or the gases and fiber out through the gap between the top of the support ring 44 and the bottom edge of the sidewall 37. High temperature silicone rubber is preferred as a seal material as it will withstand the elevated temperature in this location and remain flexible and elastic which is necessary to maintain the bias against and a good seal with the outer surface of support ring 44.

The gap 70 between the outer edge of inner ring 48 and the inner surface of support ring 44 is sealed also as will be seen later in FIG. 4 except adjacent to the wheels 42. There are gaps 70 in the seal adjacent the wheels 42 to avoid interference between the seals and the wheels and to allow ambient air to be pulled around the wheels 42 and into the interior of drum 38 through the gaps 70 to cool wheels 42.

Steel is preferred for wheels 42.

FIG. 3 also shows some detail of an inner tube 49. This tube is supported in a rigid and fixed manner to the chamber sidewalls 37 by brackets 60 and 62 and plates 46 (preferably four in number). One end of tube 49 is connected to the partial vacuum source, a high speed centrifugal fan not shown, and the other end is capped with a cap plate 51. Inner tube 49 has large holes 72 along its length between plates 48 to permit air and gases to flow from chamber 73 into the interior of tube 49.

FIG. 4 is a cross section showing how the ends of the drum are sealed between wheels 42. Another group of circumferential seals, 50, fastened to the inner ring 48 with bolts and segments of a ring retainer 52 and biased against the inner circumferential surface of support ring 44 seals the gap 70 between the wheels 42. The cap 51 has an outlet 74 preferably around the centerline of tube 49 and drum 38 which is connected to a duct 75 with gasket seal 76. Duct 75 is connected to a take off mandrel 79 which will be described in detail later. A slide gate valve 101 permits regulation of the gas/air flow through duct 75.

FIG. 5 shows how a dead or ambient zone in a chamber 86 is provided along a portion of the interior of drum 38 adjacent the inner circumferential surface of the perforated sheet 45 extending on either side of the nip between drum 38 and take-off mandrel 79. Baffles 83 and 87 attached to the inner tube 49 continuously along its length between the inner rings 48 extend outward radially towards the drum sheet 45, but stop just short of the inner circumferential surface of sheet 45. Silicone rubber seals 84 and 85 are attached to the baffles with bolts and washer strips as before described to be biased against the inner circumferential surface of sheet 45. There are no openings in the inner tube 49 between baffles 83 and 87 and thus chamber 86 is isolated from the partial vacuum inside the remainder of drum 38 and open to ambient conditions through the openings 71 in sheet 45 creating a dead or ambient condition in chamber 86. The fiber blanket on the outer surface of drum 38 can be removed more easily from the drum in the dead zone because there is no pressure drop across the blanket holding it onto the drum 38.

A roller 82 axially mounted and extending the entire width of drum 38 between chamber sidewalls 37, located several inches clockwise of the seal 84 and positioned to run against the fiber blanket collected on the drum surface provides an outer seal where surface of the rotating drum 38 exits the chamber 36. It is important to have several inches of space between roller seal 82 and seal 84. In this area the fiber blanket is being tightly held to the drum 38 by the pressure drop across the blanket. This causes the blanket to be pulled under roller 82 without sliding on the drum surface and bunching up ahead of roller 82.

A second outer seal 88 extending the entire width of drum 38 between the chamber sidewalls 37 is biased to run against the bare outer surface of the perforated sheet 45 to seal the gap between a front wall 90 of chamber 36 and the outer surface of drum 38. The seal 88 is mounted on the front side of front wall 90 along its lower edge in the manner used to mount the previously described biased seals. It folds around the bottom edge of front wall 90 to be biased against the drum 38 as the drum rotates counterclockwise. The seal 88 is positioned opposite the edge of the dead zone 86 or opposite seal 85.

Still referring to FIG. 5, a take-off mandrel 79 is axially mounted around a tube axle 89 which is held in place by clamps attached to a support 80 near each end of the tube axle 89 (FIGS. 2 and 6) such that the surface of the mandrel 79 forms a nip with the fiber blanket on the surface of drum 38 adjacent the dead zone 86. The take-off mandrel 79 is rotated clockwise such that its surface speed matches the surface speed of drum 38. The surface 96 of the mandrel 79 can be a perforated metal sheet like sheet 45, but preferably is made up of wedge shaped wire spaced apart in a parallel manner to form narrow gaps between the wires or VEE-WIRE (registered trademark of Johnson Filtration Company) having 0.020 inch gaps between the wedge shaped wires. The wires and gaps 97 run around the circumference of mandrel 79. Using VEE-WIRE on the mandrel 79 improves efficiency by as much as 3 percent compared to using perforated sheet metal.

The mandrel 79 has an interior tube axle 89 extending beyond the length of mandrel 79 on both ends. The interior of tube axle 89 is connected with the partial vacuum source with duct 75, attached in the same manner as it is attached at its other end to inner tube 49 as shown in FIG. 4. The opposite end of tube axle 89 is capped air tight.

Figure 6:
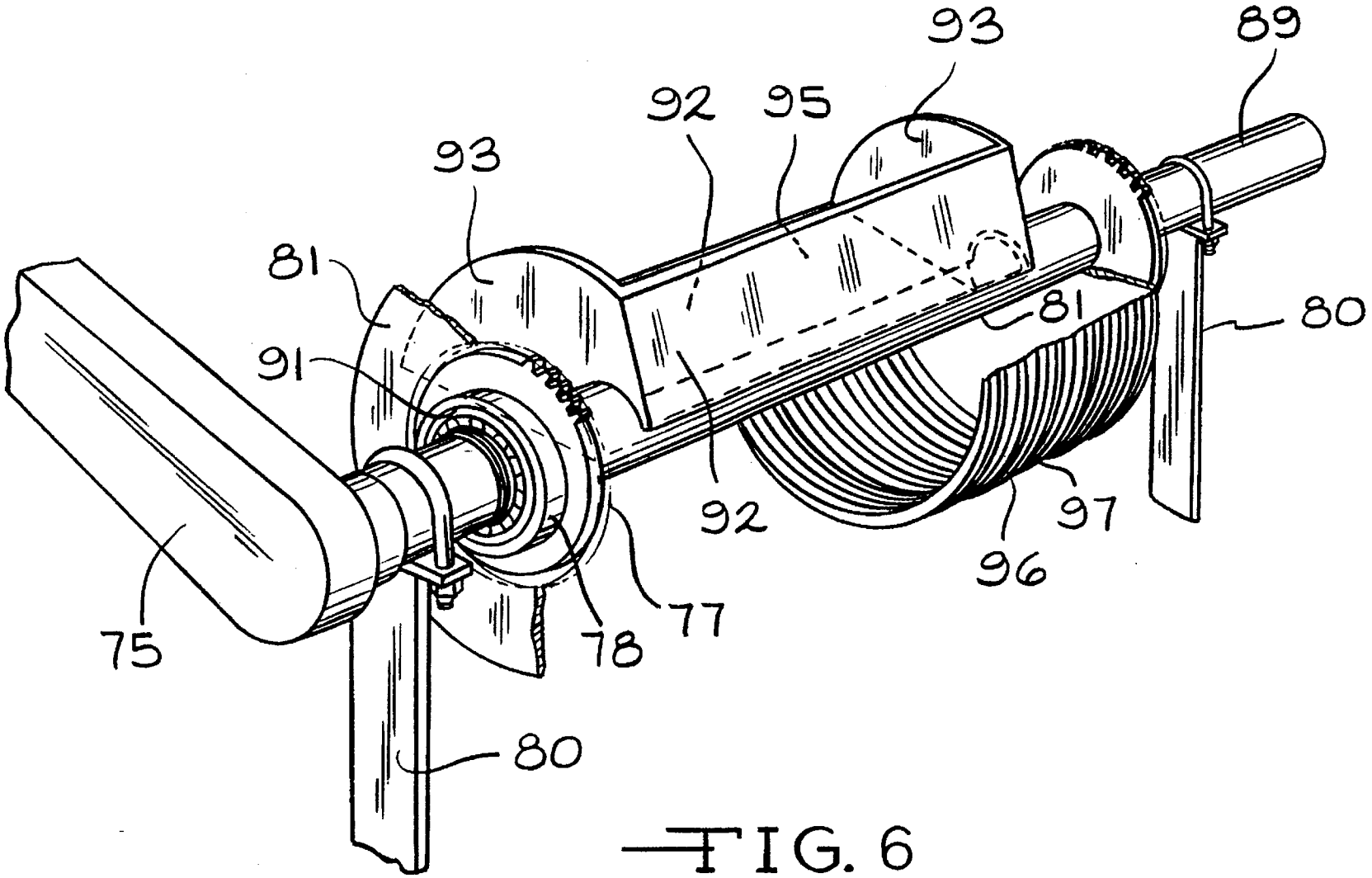
FIG. 6 is a partial cutaway view of the take off roll showing how this roll is supported and how the dead zone is created inside this roll.

Tube axle 89 is shown in more detail in FIG. 6. Two baffles 92 connect to tube 89 along its length between end plates 93 and extend towards the inner surface of the wedge shaped wire 96 leaving gaps 94 (FIG. 3) of only about 0.125 inch for clearance forming an isolated chamber 95 within mandrel 79.

The tube axle 89 has a long rectangular opening inside the confines of baffles 92 and end plates 93 to allow communication between the partial vacuum source and chamber 95. Chamber 95 lies adjacent at least 45 degrees of the surface of mandrel 79 and is stationary beginning about two circumferential inches prior to the nip with the fiber blanket on drum 38 and extending far enough around the mandrel to hold the fiber blanket until it is in position to be removed by an accumulation roller 98 (FIG. 2) or by gravity, usually at least about eight circumferential inches past the nip. The partial vacuum in chamber 95 is controlled by a sliding gate valve 101 on duct 75 as shown in FIG. 2 and is operated at a considerably lower magnitude than the partial vacuum inside the collection area of drum 38. The remainder of the interior of mandrel 79, chamber 99, is at ambient pressure or a dead zone.

The wedge shaped wire layer or VEE-WIRE (Reg. Mark) 97 is mounted at each end of mandrel 79 to a recess in the outer circumferential surfaces of end caps 81 in the same manner as sheet 45 is mounted to support ring 44, except than the outer surface of the VEE-WIRE is flush with the outermost circumferential surface of end caps 81. The length of the mandrel 79 between end caps 81 should be about as wide as the perforated width of sheet 45 on drum 38 and long enough to provide a small clearance between the inside vertical surfaces of caps 81 and the outside vertical surfaces of end plates 93, but not so long that the outer faces of caps 81 interfere with the support ring 44.

Each of the end caps 81, one on each end of the take off roll, is rigidly attached to a toothed sprocket 77 lying on the outside vertical face of the cap 81. The diameter of sprocket 77 is substantially less than that of cap 81 so that a chain that runs on the sprocket 77 to rotate take-off mandrel 79 does not interfere with support ring 44. Rigidly attached to the outside vertical surface of sprocket 77 is a smaller diameter bearing contact ring 78. A conventional bearing is rigidly attached onto and around tube axle 89 so that its running surface will run on the inner circumferential surface 91 of ring 78. The bearing is positioned along tube axle 89 such that the vertical centerline of mandrel 79 will align with the vertical centerline of drum 38.

End caps 81 have a round hole through their large, vertical surfaces centered around the center point of these surfaces. The diameter of the hole in each cap is slightly larger than the outer diameter of tube axle 89 so that caps 81 can rotate around the axle 89 without rubbing on the axle 89.

Referring again to FIG. 2, the accumulation roller 98, longer than mandrel 79, is pivotally positioned with its axial centerline being parallel to the axial centerline of mandrel 79 by an arm 102 on each end of roller 98 such that outer circumferential surface of roller 98 will run against the surface of mandrel 79. Roller 98 is free to rotate, and is driven by the driven mandrel 79 and the friction the surface of mandrel 79 and the surface of roller 98 or the fiber blanket 100 wound thereon. The other ends of arms 102 are pivotally held in place by pins on the outside of the sidewalls 37 located substantially above the axial centerline of roller 98. The weight of the arms 102 and roller 98 serve to compress the fibrous blanket 100 as it is wound up of roller 98.

The drum 38 and mandrel 79 are driven directly by a conventional variable speed drive (not shown) which rotates a shaft that is rigidly attached to a sprocket 104 on each side of the machine, each of which in turn is rigidly attached to a smaller diameter sprocket 105. The drive shaft is supported in bearings attached to the sidewalls 37 such that the sprockets 104 and 105 are located below the drum 38 between the drum and mandrel 79 and such that each sprocket 104 lies in the same plane as each respective drum sprocket 43, and each sprocket 105 lies in the same plane as each respective mandrel sprocket 77. Two idler sprockets or wheels 106 and 107 are located on each side of the machine in the same plane as sprocket 104, one on each side and below sprocket 104, and serve to cause a drive chain 108 to pass over the top of sprocket 104, around each of the idler rolls and then around drum sprocket 43. Another drive chain 110 passes around sprocket 105 and mandrel sprocket 77 on each side of the machine. This arrangement turns the drum 38 counterclockwise while turning the mandrel 79 clockwise. The diameters of sprockets 104 and 105 are so sized to produce the same circumferential surface speed on the drum 38 and the mandrel 79.

A partial vacuum sensor placed in the interior of the inner tube 49 senses the magnitude of the partial vacuum, and sends a corresponding signal to a conventional programmable controller (not shown). The controller compares this signal to the set point signal, corresponding to the desired partial vacuum in drum 38, and if different sends a signal to the drive to either increase or decrease the drive speed. Increasing the drive speed will decrease the partial vacuum and decreasing the drive speed will increase the partial vacuum in inner tube 49.

In the operation of the fiber collection system of the current invention described above according to the process of the present invention, fibers having a mean diameter of less than 1.5–2 microns, such as about 0.65 microns, in a gaseous stream are made as disclosed in U.S. Pat. No. 4,167,404 and are delivered to chamber 36, preferably after passing through the water cooled duct section 32. A partial vacuum set point in the range of 3–6 inches WC, preferably about 5 inches WC, is set on the controller and the drum drive is on. As the partial vacuum inside the drum 38 draws the gases carrying the fibers through the holes 71 in the sheet 45, fibers build up a blanket on the outer surface of drum 38. The controller will increase the rotational speed of drum 38 as the fiber blanket builds up until the set point partial vacuum is achieved. Typically a rotational speed of about 5 RPM will be maintained on a drum having a 44 inch diameter and a 46 inch width and a perforated sheet 45 having holes of 0.079 inch diameter therethrough making up 36 percent of the area of the sheet when collecting fiber at the rate of about 43–44 lbs./hr. At this fiber collection rate, the much larger collection drum in the prior art Loeffler collection system has to rotate at least three times this fast.

As the drum 38 rotates counterclockwise, the fiber blanket passes under roller seal 82 which is raised and held away from the surface of drum 38 until the fiber blanket reaches the nip between drum 38 and mandrel 79. At that time roller seal is released and allowed to be biased against the moving fiber blanket causing the roller seal to rotate and perform its function of sealing the exit from chamber 36.

The gate valve 101 in duct 75 is adjusted to achieve about 1.5 inches of WC partial vacuum in chamber 95 in mandrel 79. As the fiber blanket 100 passes the seal 84 and becomes adjacent the dead zone 86 the blanket can be easily removed from the surface of drum 38. As the blanket 100 passes through the nip between drum 38 and mandrel 79 it is compressed and held tightly to the surface of mandrel 79 by the partial vacuum in chamber 95 and is thus completely transferred from drum 38 to mandrel 79. Optionally, compressed air at 50 psi or higher can be blown from a manifold 112 located inside the dead zone 86 through 0.032 inch holes 114 on 0.25 inch centers just past the nip to clean out the holes 71 and to help transfer the blanket 100, as shown in FIG. 5.

As the blanket passes the down stream edge of chamber 95 there is no longer a partial vacuum on the interior of the mandrel adjacent this part of the blanket and therefore it will fall off the drum by gravity as it rotates clockwise with the drum and can be baled in a known manner. Alternatively, the blanket can be wound up on a mandrel as shown in FIGS. 2 and 5 before it falls off the mandrel and then later stripped from the mandrel, also a known practice.

The fiber coming off the drum is less than 125 degrees Fahrenheit, normally less than 90 degrees. When the fiber comes off the take off mandrel it is less than 90 degrees and normally less than about 75 degrees Fahrenheit. This compares to a fiber temperature of at least about 250–350 degrees Fahrenheit as fiber comes off the drum in the Loeffler system.

The present invention has at least about 12 percent higher productivity than the prior art Loeffler system in terms of pounds per hour of collected fiber per the same fiber attenuation burner used in both systems. Alternatively, the same amount of production rate of fiber having a mean diameter of about 0.65 microns can be produced in the current system using 20–25 percent less fuel than required in the Loeffler system. Also, the seals last much longer with the present system than with the Loeffler system, requiring less downtime and lost production for maintenance.

Finally, the fiber product of this invention is uniquely different than prior products of this type. This is believed to be due to a larger percentage of the finest and shortest fibers being present in the product of the present invention, the majority of the blanket having been collected on top of a thicker and denser fiber blanket than in the Loeffler system.

We claim:

1. In an apparatus for collecting fibers having a mean fiber diameter less than about 1.5–2 microns from a gaseous stream to form a fibrous blanket, comprising a rotatable drum having ends and a permeable inner and outer circumferential surface, supports for said drum, means for rotating said drum, a partial vacuum source of at least one-half inch water column communicating with an inside portion of said drum, seals cooperating with the surfaces of said drum to constrain the partial vacuum to a selected portion of the interior of said permeable drum, a chamber surrounding a major portion of the circumferential surface of said drum and having an inlet for said gaseous stream, and means for removing the fiber blanket, the improvement comprising, the outer circumferential surface of said drum being a perforated metal sheet having holes therethrough with a diameter up to 0.1 inch, the cross sectional area of said holes making up at least 20 percent of the area of the outer circumferential surface of said perforated sheet, the supports for said drum engaging the inner circumferential surfaces at or close to the ends of said drum in a low friction manner so that the drum can rotate freely, said supports being held in place by holding means mounted to said chamber, and seals biased against a plurality of surfaces of said drum as the drum rotates, said seals cooperating with said partial vacuum source to achieve at least minus two inches of water column in a major portion of a region adjacent an interior circumferential surface of said drum while the remainder of the region adjacent the interior circumferential surface of said drum is at essentially ambient pressure, one of said seals being flexible and contacting an outside circumferential surface of said drum at or near each end and another seal contacting an inner, fixed ring and the inside circumferential surfaces of said drum at or near each end, said another seal being flexible and having gaps therein adjacent said drum supports to avoid interference between said another seal and said drum supports and to allow ambient air to be pulled around said supports to cool said supports.

2. The apparatus of claim 1 wherein the improvement further comprises a section of duct having at least one approximately ninety degree turn therein attached to said inlet, said duct section entering said chamber in a direction parallel or tangential to the outer circumferential surface of said drum.

3. The apparatus of claim 2 wherein at least a portion of the outer surfaces of said duct section are water cooled.

4. The apparatus of any of claims 1–3 wherein the improvement further comprises a rotating take-off mandrel adjacent the collection drum, a portion of the interior of said mandrel being connected to a partial vacuum source.

5. The apparatus of any of claims 1–3 wherein said seals and partial vacuum source produce a partial vacuum in a portion of said collection drum of at least about 3 inches of water column when the apparatus is operating producing said fibrous blanket.

6. The apparatus of any one of claims 1–3 wherein said low friction supports are rollers rotatably held by brackets attached to said chamber walls.

7. In a method of collecting fibers having a mean diameter of less than 1.5–2 microns into a fibrous blanket on a rotating drum having an inner and outer surface by passing a gaseous stream containing said fibers through an inlet into a chamber and pulling the gases through a permeable surface of a rotating drum to form said blanket on the outside of said permeable surface by creating a partial vacuum of at least one-half inch water column in a portion of the interior of said drum, and removing the blanket from said drum, the improvement comprising, supporting said drum while the drum is rotating with low friction supports contacting the inner circumferential surface at or near each end of said drum and sealing said portion of the interior of said drum from ambient pressure and from the remainder of the interior of said drum with seals, one of said seals being flexible and contacting a wall of said chamber and an outside circumferential surface of said drum at or near each end and another of said seals being flexible and contacting a fixed inner ring and an inner circumferential surface of said drum at or near each end, said another of said seals having gaps therein adjacent said low friction supports to allow ambient air to be pulled around said supports to cool said supports and maintaining said partial vacuum at a level of at least about minus 3 inches of water column.

8. The method of claim 7 wherein the partial vacuum in said drum is maintained at least about minus 5 inches of water column.

9. The method of claim 7 wherein the fibers are removed from the collection drum adjacent an ambient pressure zone in the drum using a take off mandrel and maintaining a partial vacuum of about 1.5 inches of water column in the interior of a portion of the interior of the mandrel adjacent where it first contacts the fibers on the drum.

10. The method of any one of claims 7–9 wherein the gaseous stream carrying the fibers is cooled by contact with a water cooled surface prior to removing the fibers from the gaseous stream.

11. The method of any one of claims 7–9 wherein the gaseous stream containing the fibers entrained therein is passed through a duct section having at least two ninety degree turns therein prior to removing the fibers from the gaseous stream.

12. The method of any of claims 7–9 wherein said low friction supports are rollers rotatably held by brackets attached to said chamber walls.

* * * * *